US011214978B2

(12) United States Patent
McConnell

(10) Patent No.: US 11,214,978 B2
(45) Date of Patent: Jan. 4, 2022

(54) FENCE INSTALLATION SYSTEM

(71) Applicant: Nevin McConnell, Fort Morgan, CO (US)

(72) Inventor: Nevin McConnell, Fort Morgan, CO (US)

( * ) Notice: Subject to any disclaimer, the term of this patent is extended or adjusted under 35 U.S.C. 154(b) by 173 days.

(21) Appl. No.: 16/787,788

(22) Filed: Feb. 11, 2020

(65) Prior Publication Data

US 2021/0246686 A1 Aug. 12, 2021

(51) Int. Cl.
*E04H 17/26* (2006.01)
*E04H 17/02* (2006.01)

(52) U.S. Cl.
CPC ..... *E04H 17/263* (2013.01); *E04H 17/02* (2013.01); *E04H 17/266* (2013.01)

(58) Field of Classification Search
CPC ..... E04H 17/02; E04H 17/26; E04H 17/261; E04H 17/263; E04H 17/266; E04H 17/127
See application file for complete search history.

(56) References Cited

U.S. PATENT DOCUMENTS 1,912,812 A 8/1933 Erdahl
2,474,981 A * 7/1949 McCardell ..... E21B 7/028 173/145
2,614,805 A * 10/1952 Swan ..... E21B 19/087 173/26
2,776,110 A 1/1957 Hoistad
2,789,778 A * 4/1957 Zogg ..... B65H 75/425 242/423.1
3,302,731 A 2/1967 Perry
3,934,655 A * 1/1976 Whistle ..... B65H 49/32 173/46
4,050,526 A * 9/1977 Deike ..... E02D 7/10 173/27
4,212,358 A * 7/1980 Wisbrock ..... E21B 7/028 173/195
4,706,935 A 11/1987 Thompson
5,248,001 A 9/1993 Moseley
6,591,919 B1 * 7/2003 Herrmann ..... E02D 7/10 173/184
6,675,916 B1 * 1/2004 Mathews ..... E21B 7/005 175/162
7,004,262 B1 2/2006 Voichoskie
7,264,195 B2 * 9/2007 Fletcher ..... B65H 49/32 242/557
7,699,259 B2 * 4/2010 Rawcliffe ..... E04H 17/266 242/557

(Continued)

*Primary Examiner* — Jonathan P Masinick

(57) ABSTRACT

A fence installation system for automating the fence installation process includes a trailer apparatus. A post dispenser apparatus is configured to secure a plurality of fence posts. A post holder apparatus comprises a first robotic arm and a claw configured to secure a fence post. A post hole drill apparatus is coupled to the trailer apparatus and comprises a second robotic arm, a drill head, and an auger bit. A post driver apparatus comprises a third robotic arm and a driver head configured to drive the fence post into the ground. A fence wiring apparatus comprises a spool axle and a plurality of wire spools coupled to the spool axle. A control apparatus is in operational communication with each of the post holder apparatus, the post hole drill apparatus, the post driver apparatus, and the fence wiring apparatus.

13 Claims, 11 Drawing Sheets

(56) References Cited

U.S. PATENT DOCUMENTS

| | | | | |
|---|---|---|---|---|
| D693,375 | S | 11/2013 | Chlystek | |
| 9,022,136 | B2 * | 5/2015 | Tate | E04H 17/261 173/46 |
| 9,797,159 | B2 * | 10/2017 | Breeden, III | E21B 7/02 |
| 10,837,196 | B2 * | 11/2020 | Cowan | B65H 49/26 |
| 2004/0065768 | A1 * | 4/2004 | Parker | B65H 49/32 242/557 |
| 2010/0089602 | A1 * | 4/2010 | Tanner | E04H 17/263 173/27 |
| 2011/0121125 | A1 * | 5/2011 | Stow | B66F 9/184 242/557 |
| 2016/0138299 | A1 * | 5/2016 | Powers, III | E04H 17/263 173/184 |
| 2017/0204633 | A1 | 7/2017 | Hubener | |
| 2019/0264411 | A1 * | 8/2019 | Erhardt | E02F 3/413 |

* cited by examiner

FENCE INSTALLATION SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to fence construction devices and more particularly pertains to a new fence construction device for automating the fence installation process.

(2) Description of Related Art Including Information Disclosed Under 37 CFR 1.97 and 1.98

The prior art relates to fence construction devices. Existing fence construction devices are typically limited to a single element of the process, particularly drilling pole holes and tamping. Existing devices also must be moved independently and thus require a number of tractors or other motorized transports to be used in unison. Furthermore, these devices typically do not address the handling and manipulation of each fence post but rather deal with an individual post that has been manually placed.

BRIEF SUMMARY OF THE INVENTION

An embodiment of the disclosure meets the needs presented above by generally comprising a trailer apparatus comprising a chassis, a plurality of wheels coupled to the chassis, and a hitch coupled to the chassis. The hitch is configured to selectively engage a tractor. A post dispenser apparatus is coupled to the trailer apparatus and comprises a dispenser body coupled to the chassis. The dispenser body defines a post storage cavity configured to secure a plurality of fence posts and having an open dispenser top side extending through to the post storage cavity. A feeder tray is coupled to the dispenser body and extends from a dispenser inner side adjacent a dispenser bottom side. A feed aperture extending through the dispenser inner side to the post storage cavity. A post holder apparatus is coupled to the trailer apparatus and comprises a first robotic arm coupled to the chassis and a claw coupled to the first robotic arm. The claw is configured to secure a fence post. A post hole drill apparatus is coupled to the trailer apparatus and comprises a second robotic arm coupled to the chassis, a drill head coupled to the second robotic arm, and an auger bit coupled to the drill head. A post driver apparatus is coupled to the trailer apparatus and comprises a third robotic arm coupled to the chassis and a driver head coupled to the third robotic arm. The driver head has a hydraulic piston configured to drive the fence post into the ground. A fence wiring apparatus is coupled to the trailer apparatus and comprises a spool axle coupled to the chassis and a plurality of wire spools coupled to the spool axle. A control apparatus is in operational communication with each of the post holder apparatus, the post hole drill apparatus, the post driver apparatus, and the fence wiring apparatus.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
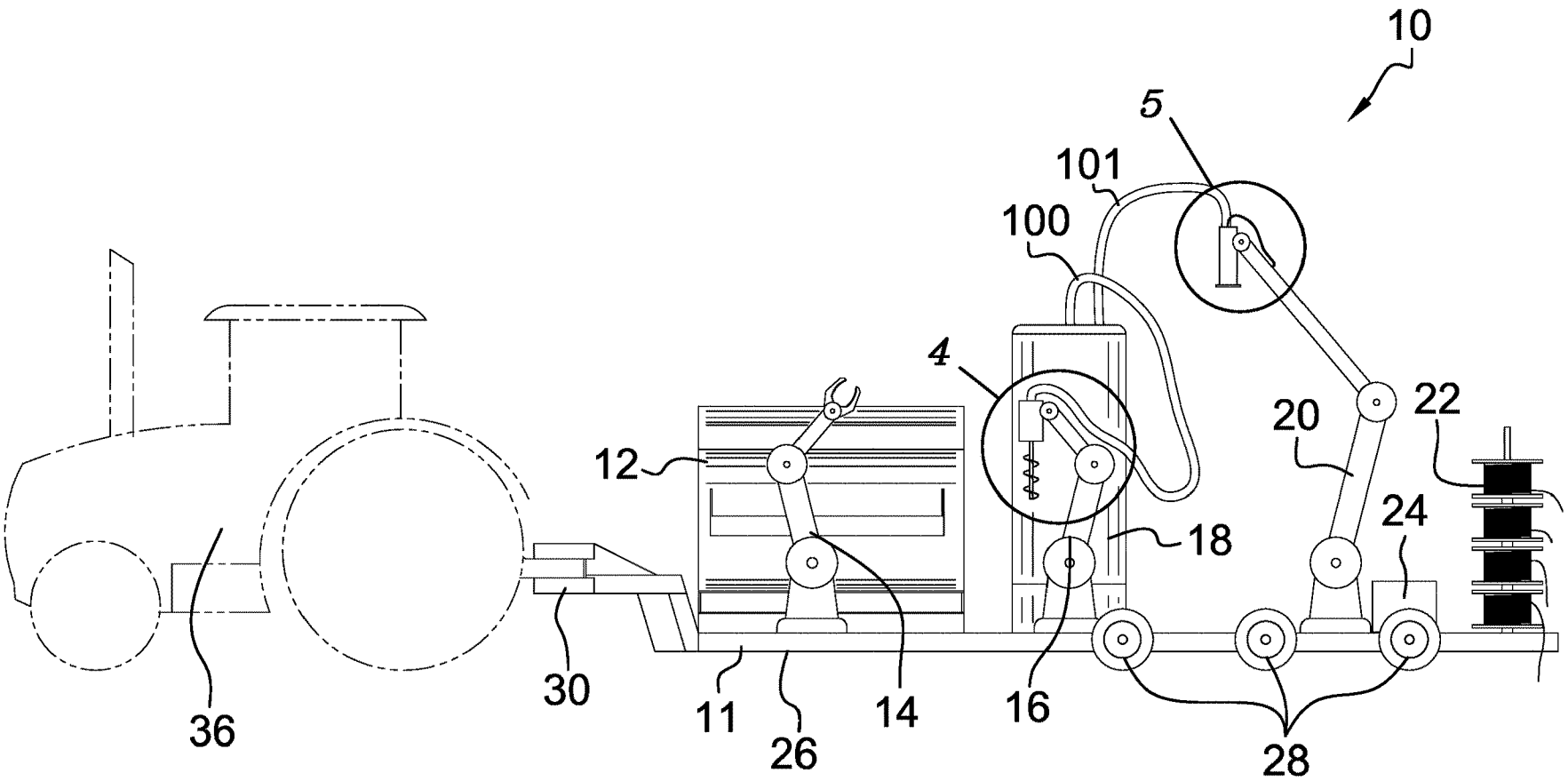
FIG. 1 is a side elevation view of a fence installation system according to an embodiment of the disclosure.
Figure 2:
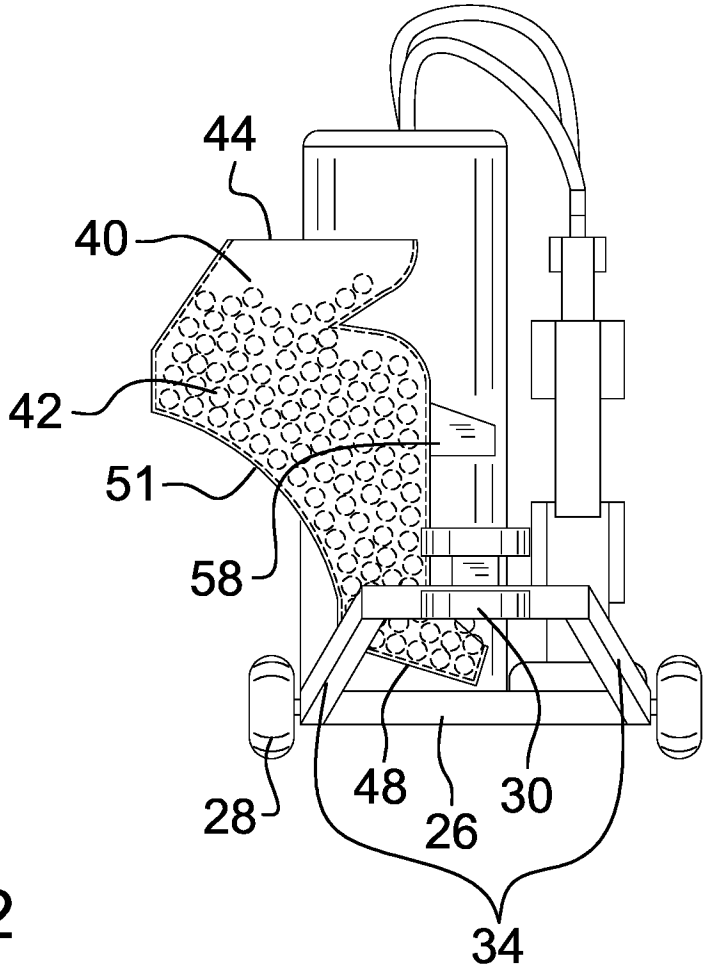
FIG. 2 is a side elevation view of an embodiment of the disclosure.
Figure 3:
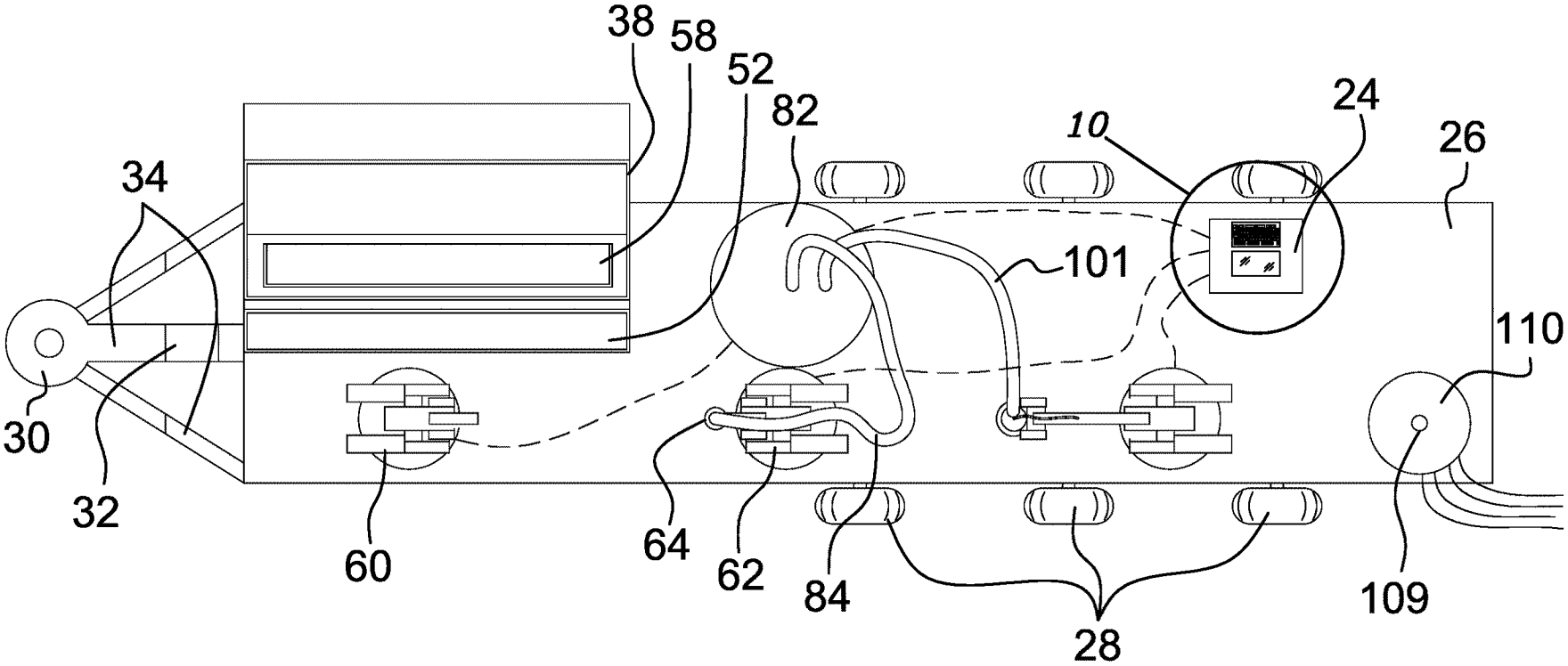
FIG. 3 is a top plan view of an embodiment of the disclosure.
Figure 4:
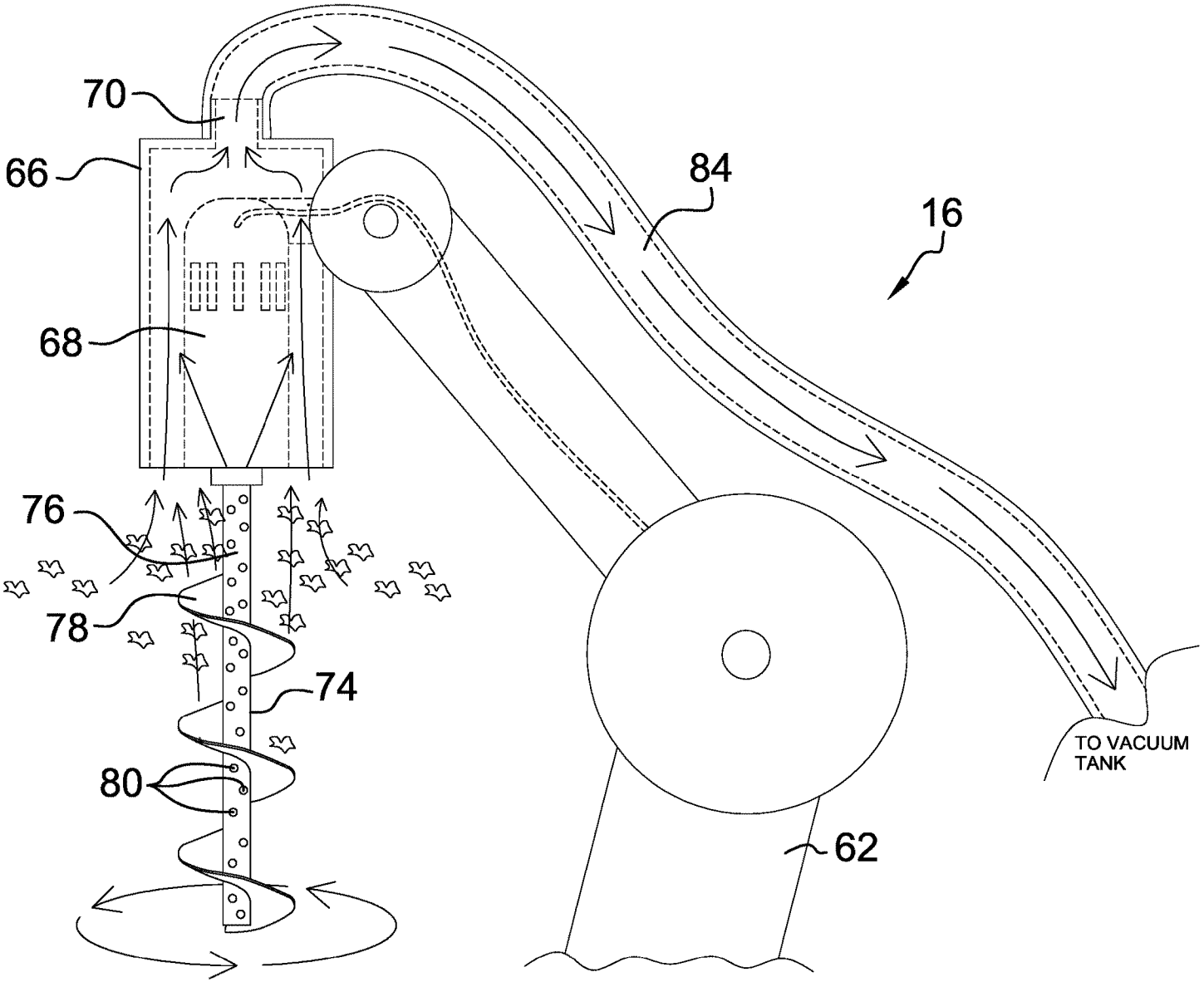
FIG. 4 is a detail view of an embodiment of the disclosure.
Figure 5:
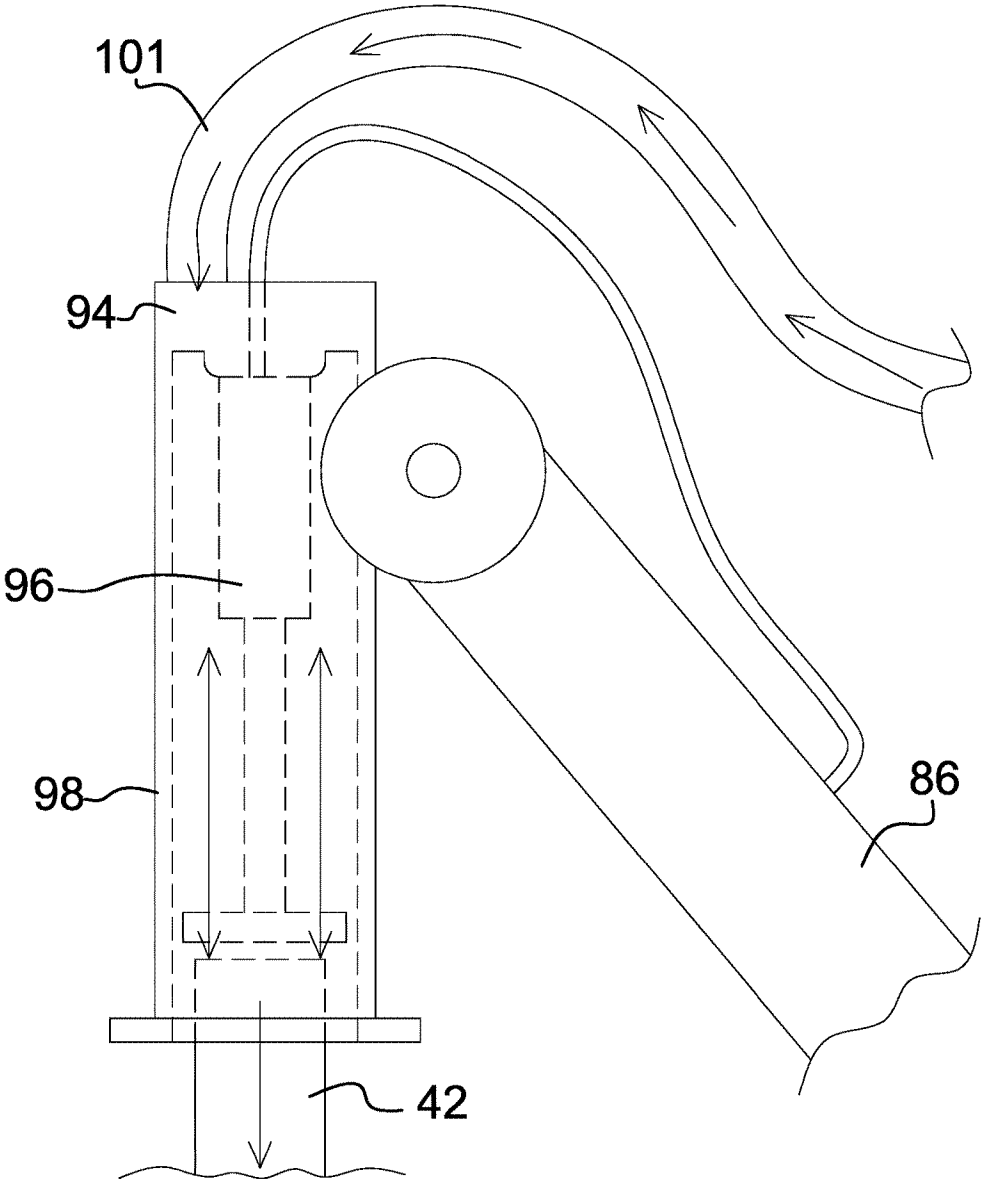
FIG. 5 is a detail view of an embodiment of the disclosure.
Figure 6:
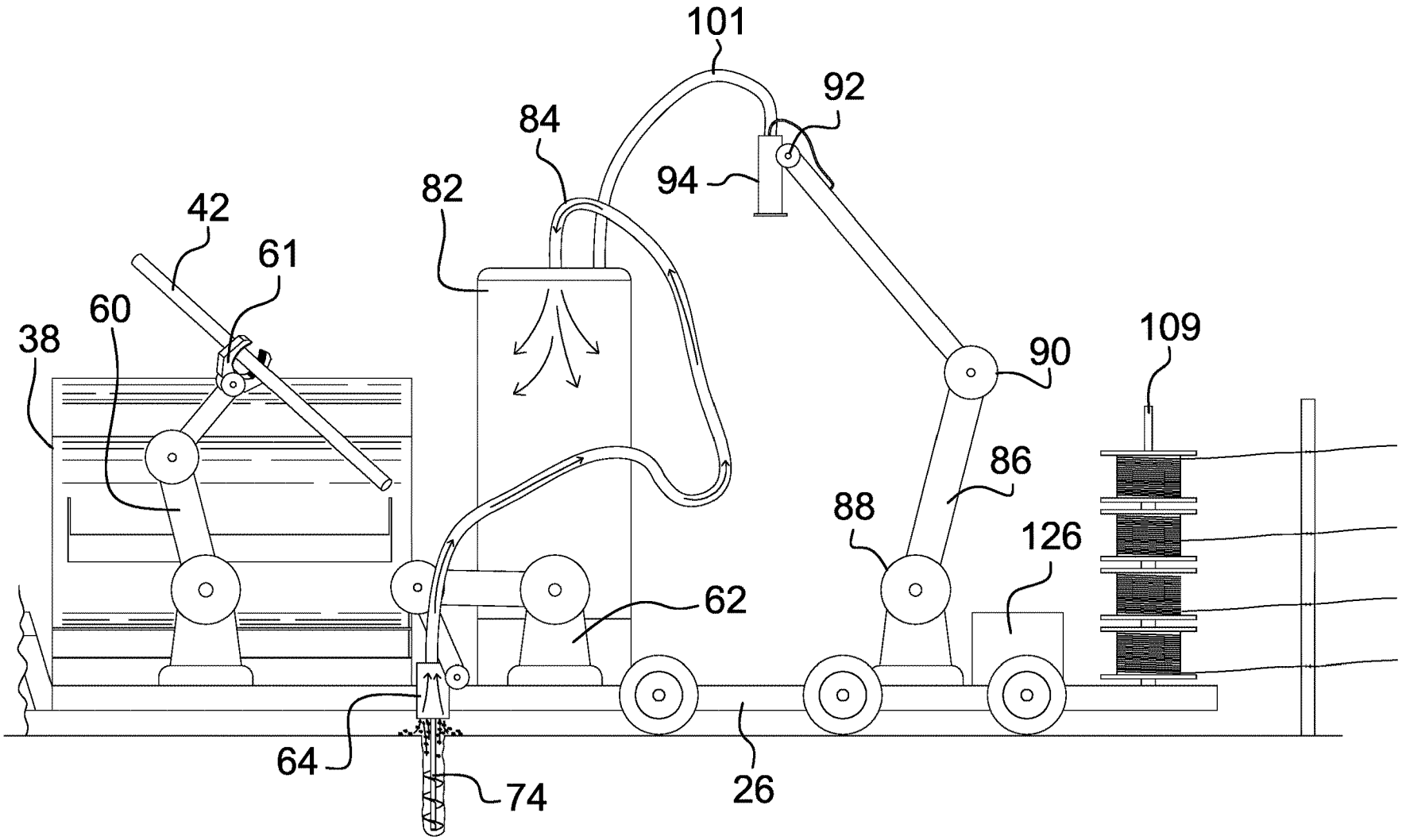
FIG. 6 is an in-use view of an embodiment of the disclosure.
Figure 7:
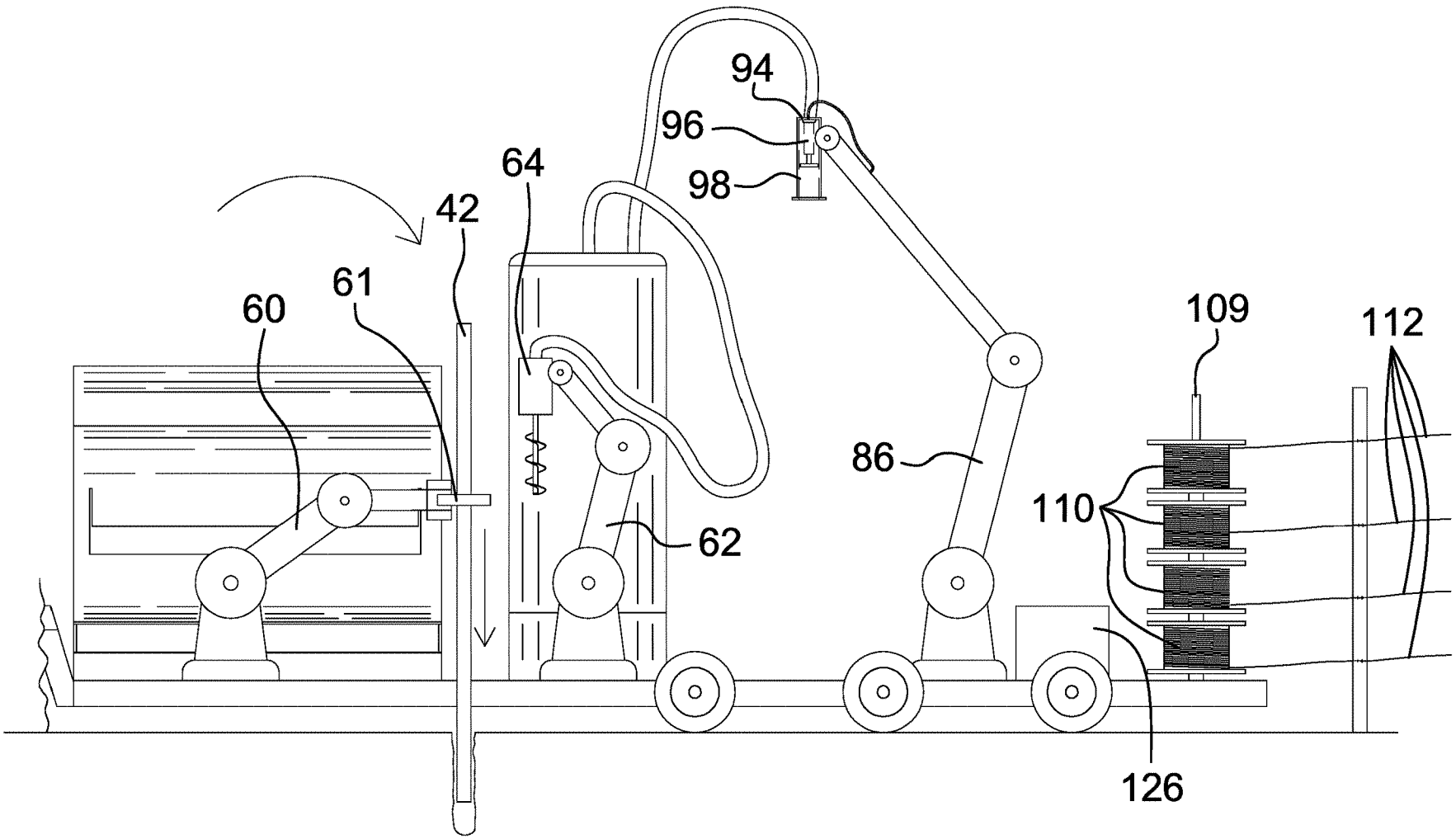
FIG. 7 is an in-use view of an embodiment of the disclosure.
Figure 8:
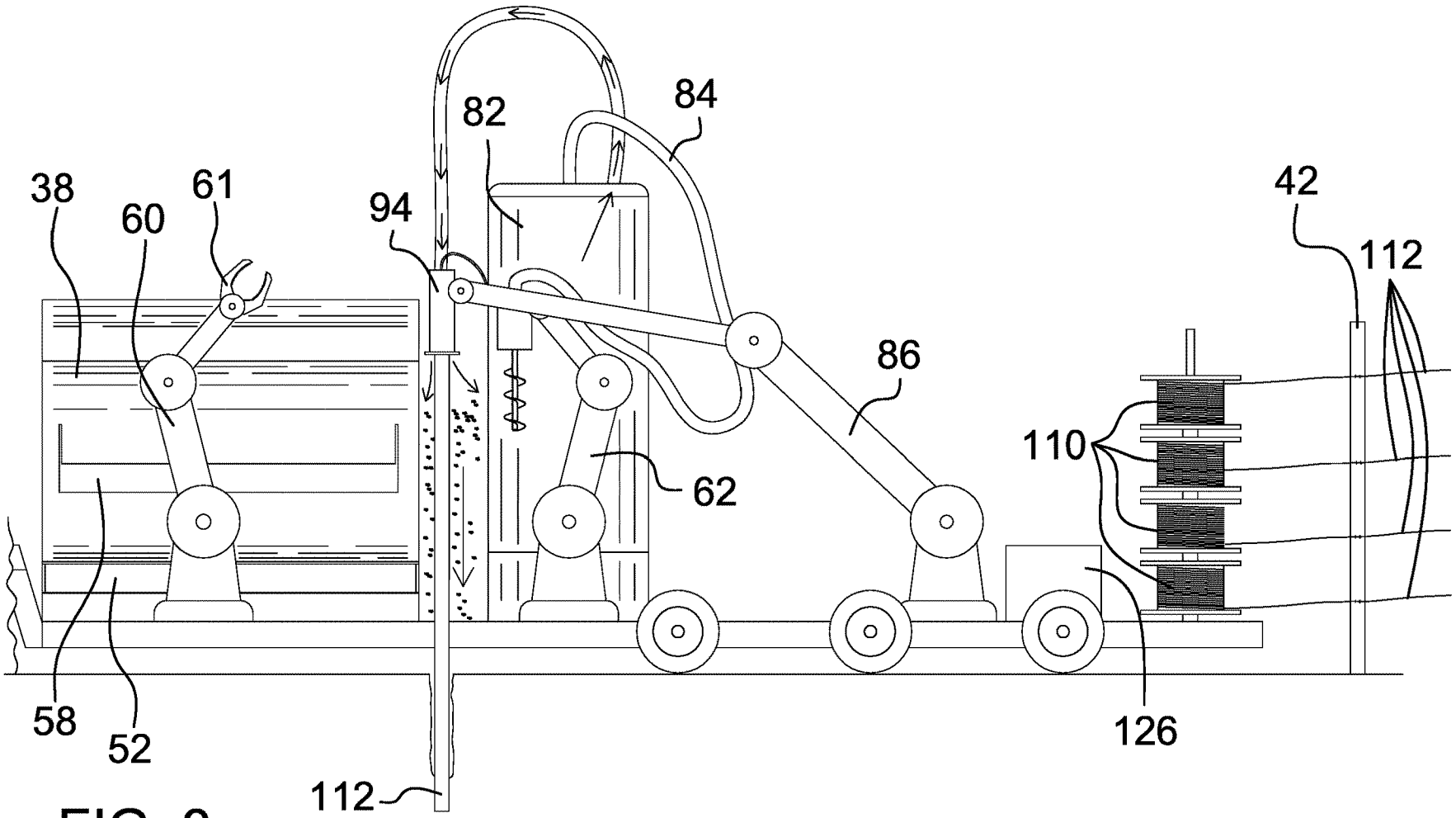
FIG. 8 is an in-use view of an embodiment of the disclosure.
Figure 9:
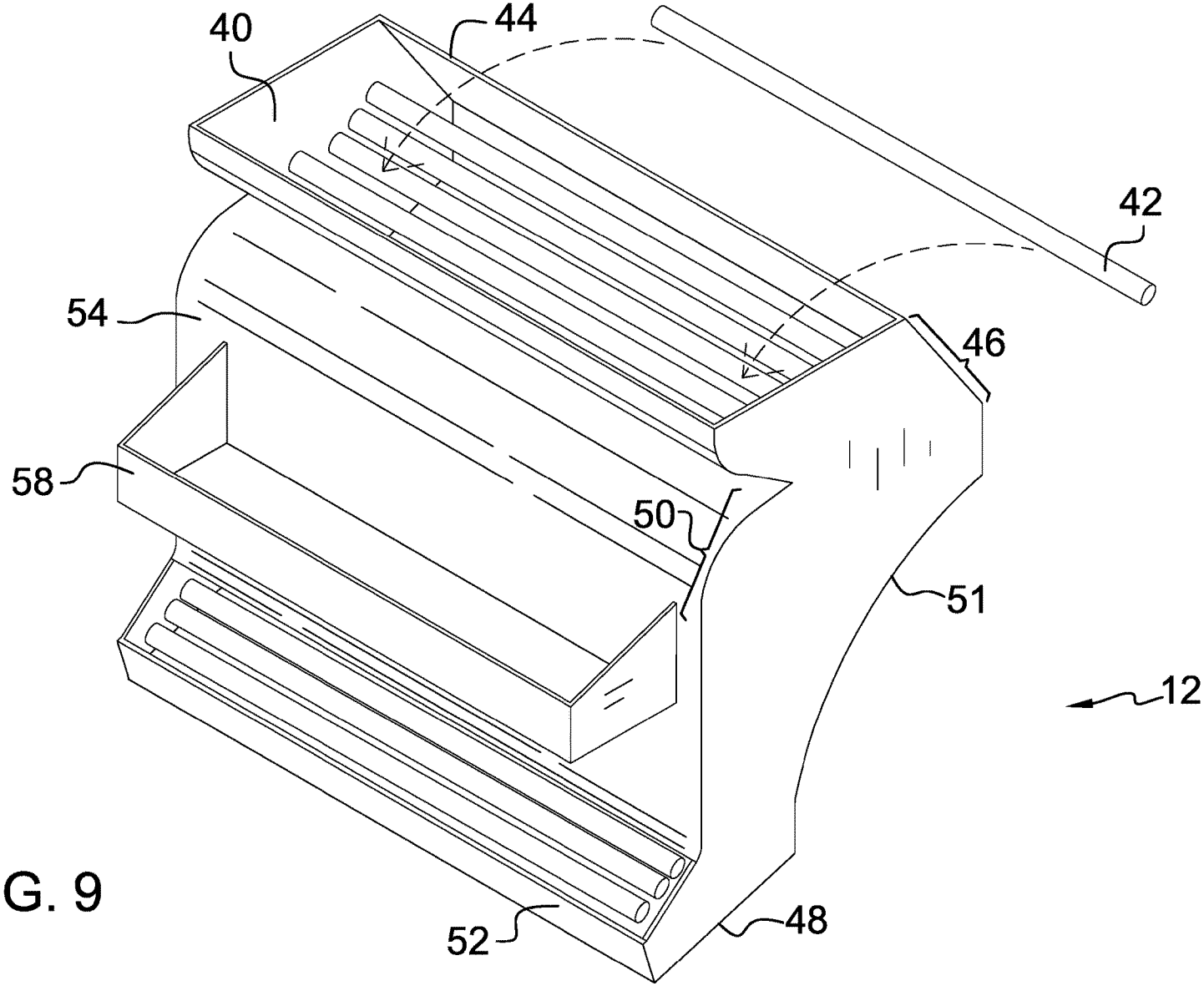
FIG. 9 is a detail view of an embodiment of the disclosure.
Figure 10:
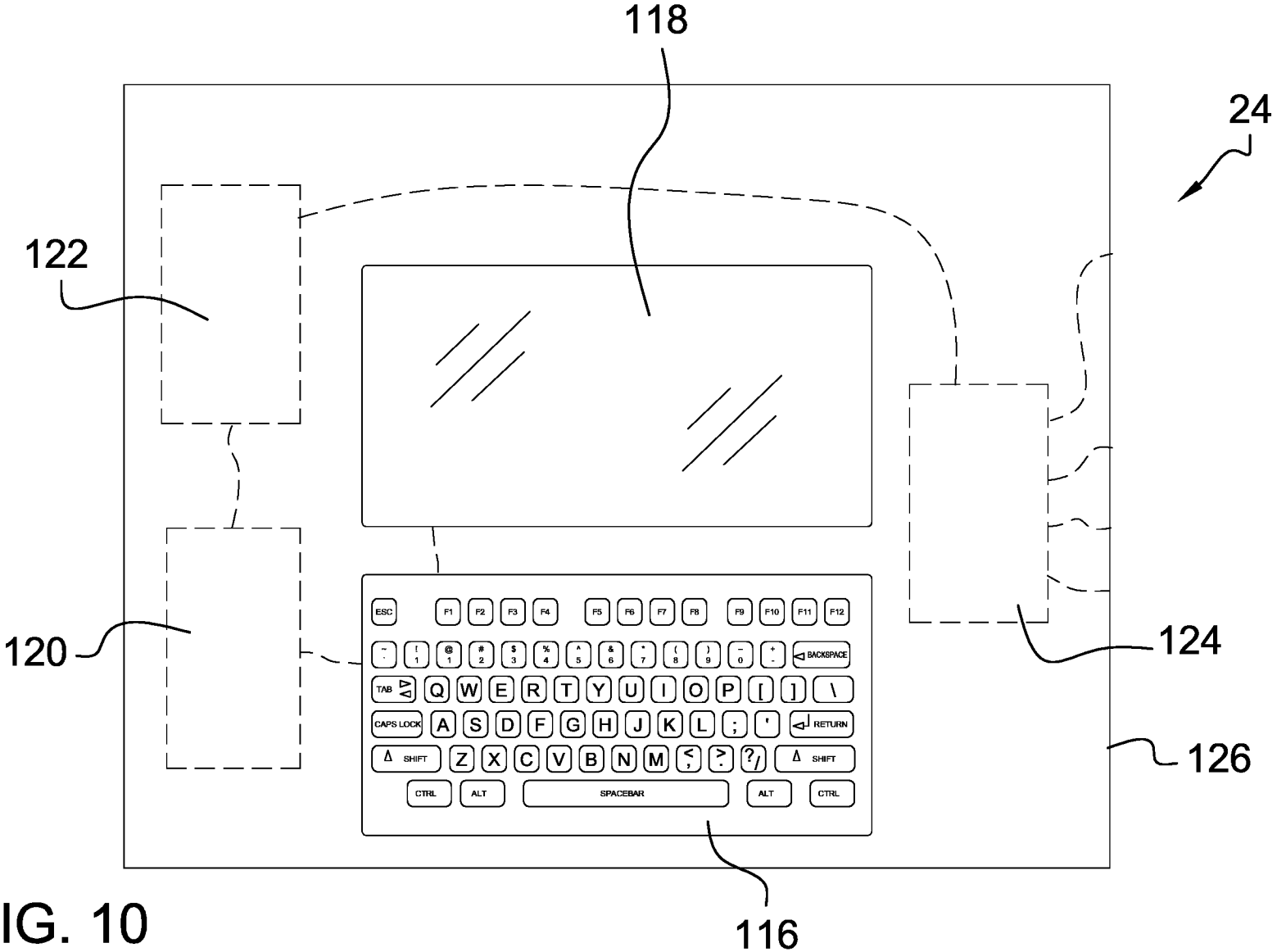
FIG. 10 is a schematic view of an embodiment of the disclosure.
Figure 11:
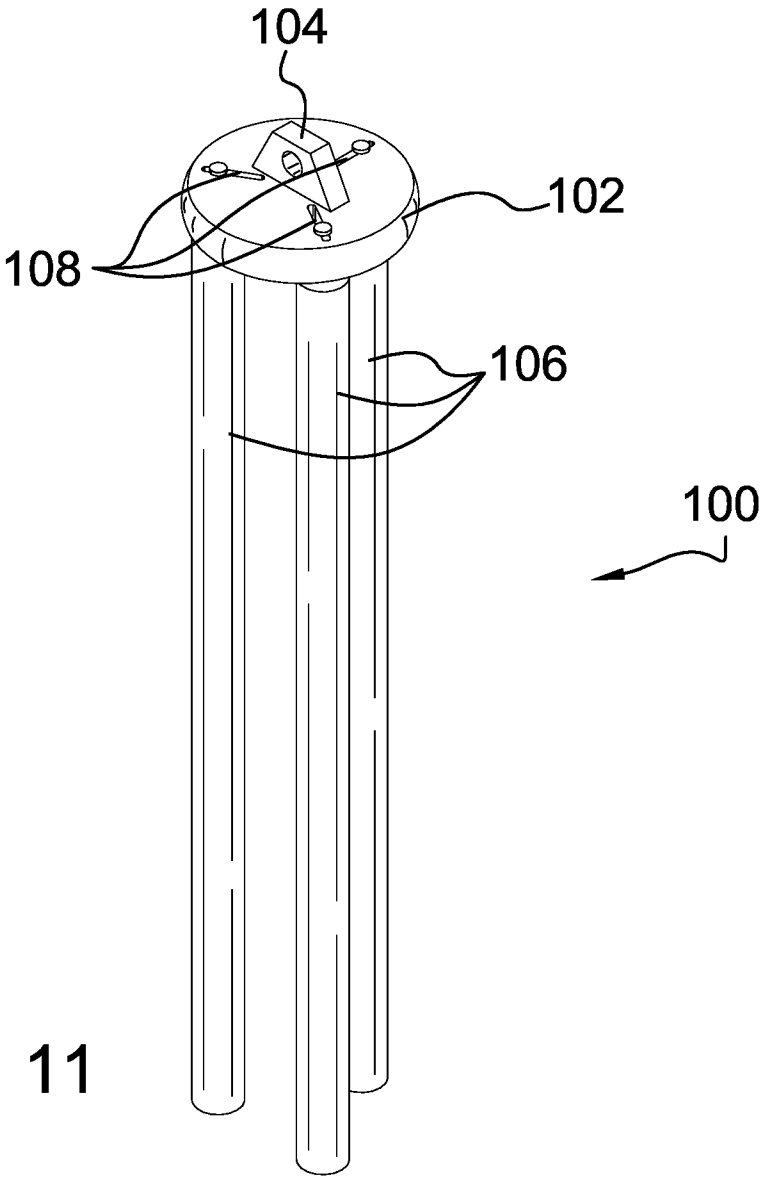
FIG. 11 is a detail view of an embodiment of the disclosure.

With reference now to the drawings, and in particular to FIGS. 1 through 11 thereof, a new fence construction device embodying the principles and concepts of an embodiment of the disclosure and generally designated by the reference numeral 10 will be described.

As best illustrated in FIGS. 1 through 11, the fence installation system 10 generally comprises a trailer apparatus 11, a post dispenser apparatus 12, a post holder apparatus 14, a post hole drill apparatus 16, a vacuum apparatus 18, a post driver apparatus 20, a fence wiring apparatus 22, and a control apparatus 24. The trailer apparatus 11 comprises a chassis 26, a plurality of wheels 28 coupled to the chassis 24, and a hitch 30 coupled to the chassis 24. The hitch 30 may have an extension arm 32 extending upwards and forwards from the chassis 24 and a pair of angled support arms 34 for structural stability. The hitch 30 is configured to selectively engage a tractor 36.

The post dispenser apparatus 12 comprises a dispenser body 38 coupled to the chassis 24 proximal the hitch 30. The dispenser body 38 defines a post storage cavity 40 configured to secure a plurality of fence posts 42 and having an open dispenser top side 44 extending through to the post storage cavity 40. The dispenser body 38 may have an angled upper extension portion 46 to maximize the number of fence posts 42 it can secure and to aid the flow of fence posts 42 towards a dispenser bottom side 48. A medial holder portion 50 further aids this flow and a curved dispenser outer side 51 prevents the dispenser body 38 from interfering with objects closer to the ground adjacent the trailer apparatus 12. A feeder tray 52 is coupled to the dispenser body 38 and extends from a dispenser inner side 54 adjacent the dispenser bottom side 48. A feed aperture 56 extends through the dispenser inner side 54 to the post storage cavity 40 to expose fence posts 42 to be installed. A storage tray 58 may be coupled to the dispenser inner side 54 above the feeder tray 52 and is configured to secure shorter fence posts so they are not comingled with the standard sized fence posts 42 in the post storage cavity 40.

The post holder apparatus 14 comprises a first robotic arm 60 coupled to the chassis 26 proximal the post dispenser apparatus 12. A claw 61 is coupled to the first robotic arm 60 and is configured to secure the fence posts 42. The post holder apparatus 14 is configured to retrieve the fence post 42 from either the feeder tray 52 or the storage tray 58 and position the fence post 42 in the ground.

The post hole drill apparatus 16 comprises a second robotic arm 62 coupled to the chassis 26 and a drill head 64 coupled to the second robotic arm 62. The drill head 64 may have an outer shroud 66 and a drill motor 68 centrally coupled within the outer shroud 66. The outer shroud 66 has an exhaust port 70 extending through a shroud top side 72. An auger bit 74 has a bit shaft 76 coupled to the drill motor 68 and a helical blade 78 extending from the bit shaft 76. The bit shaft 76 may be hollow and may have a plurality of suction apertures 80 extending therethrough. The auger bit 74 may be available in a range of sizes for use depending on the size of the fence post 42 being installed.

The vacuum apparatus 18 comprises a vacuum tank 82 coupled to the chassis 26 adjacent the second robotic arm 62. The vacuum tank 82 may be cylindrical and dimensioned to hold 0.5 cubic yards of dirt and debris. A suction hose 84 extends from the vacuum tank 82 to the exhaust port 70 of the outer shroud of the drill head. The bit shaft 76 is in fluid communication with the suction hose 84 to draw dirt through the suction apertures 80. The vacuum tank is configured to be activated concurrently with the drill motor 68 to aid in post hole creation. A waste gate of the vacuum tank 82 is opened to remove the dirt and debris.

The post driver apparatus 20 comprises a third robotic arm 86 coupled to the chassis 26. Each of the first robotic arm 60, the second robotic arm 62, and the third robotic arm 86 may have a base pivot 88, a medial pivot 90, and a distal pivot 92 to achieve at least five-axis movement and rotation. A driver head 94 is coupled to the third robotic arm 86 and may be 360° rotatable. The driver head 94 has a hydraulic piston 96 configured to drive the fence post 42 into the ground. There may be a cylindrical sheath 98 around the piston 96 to maintain the post in a plumb orientation. Depending on the hardness of the ground the post driver apparatus 20 may be used without the post hole drill apparatus 16 and the vacuum apparatus 18.

A tamping head 100 may be included for use when the ground is too hard for the piston 96 to drive the fence post 42 into the ground and the auger bit 74 has been used to pre-drill a hole. A replacement hose 101 may be coupled to the vacuum tank 82 and extends to the driver head 94 to replace dirt and debris from the vacuum tank 82 into the hole. The tamping head 100 tamps in the dirt around the fence post 42 to set the fence post 42 and to prevent water from entering the hole and rotting the fence post 42. The tamping head 100 tamps the dirt until it is level with the ground. The tamping head 100 has a crown 102 with a quick connect 104 selectively engageable with the driver head 94. At least three tamping rods 106 extend from the crown 102. Each tamping rod 106 may be slidably coupled within a plurality of adjustment slots 108 radially extending through the crown 102 to accommodate fence posts 42 of different diameter. The tamping rods 106 are then used to pack the dirt around the fence post 42.

The fence wiring apparatus 22 comprises a spool axle 109 coupled to the chassis 26. A plurality of wire spools 110 is rotatably coupled to the spool axle 109 to simultaneously feed multiple rows of wire 112 along the fence posts 42. The fence wiring apparatus 22 may include a fourth robotic arm 60 having a stapler 114 to fix the wire 112 to the fence posts 42.

The control apparatus 24 is in operational communication with each of the post holder apparatus 14, the post hole drill apparatus 16, the post driver apparatus 20, and the fence wiring apparatus 22. The control apparatus 24 has a control panel 116, a display screen 118, a GPS unit 120, a CPU 122, and a power management center 124 coupled within a control housing 126. The control housing 126 is selectively engageable with the chassis 26 or within a cab of the tractor 36. The power management center 124 is configured to be in operational communication with a power generator of the tractor.

In use, the trailer apparatus 11 is attached to the tractor 36 and the control apparatus 24 is used to program the desired fence to be built. As the system 10 is moved, the GPS unit 120 can then dictate where each fence post 42 is to be installed. The post hole drill apparatus 16 creates a post hole, the post holder apparatus 14 then places the fence post 42 from the post dispenser apparatus 12 into the post hole, and the post driver apparatus 20 secures the fence post 42 in place. The fence wiring apparatus 22 then attaches the rows of wire 112 to the fence post 42 and unwinds the rows of wire 112 from the wire spools 110 as the trailer apparatus 11 moves to the next location.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fence installation system comprising:

a trailer apparatus comprising a chassis, a plurality of wheels coupled to the chassis, and a hitch coupled to the chassis, the hitch being configured to selectively engage a tractor;

a post dispenser apparatus coupled to the trailer apparatus, the post dispenser apparatus comprising:

a dispenser body coupled to the chassis, the dispenser body defining a post storage cavity configured to secure a plurality of fence posts and having an open dispenser top side extending through to the post storage cavity; and a feeder tray coupled to the dispenser body, the feeder tray extending from a dispenser inner side adjacent a dispenser bottom side, a feed aperture extending through the dispenser inner side to the post storage cavity;

a post holder apparatus coupled to the trailer apparatus, the post holder apparatus comprising:

a first robotic arm coupled to the chassis; and a claw coupled to the first robotic arm, the claw being configured to secure a fence post;

a post hole drill apparatus coupled to the trailer apparatus, the post hole drill apparatus comprising:

a second robotic arm coupled to the chassis;

a drill head coupled to the second robotic arm; and an auger bit coupled to the drill head;

a post driver apparatus coupled to the trailer apparatus, the post driver apparatus comprising:

a third robotic arm coupled to the chassis; and a driver head coupled to the third robotic arm, the driver head having a hydraulic piston configured to drive the fence post into the ground;

a fence wiring apparatus coupled to the trailer apparatus, the fence wiring apparatus comprising:

a spool axle coupled to the chassis; and a plurality of wire spools coupled to the spool axle; and a control apparatus, the control apparatus being in operational communication with each of the post holder apparatus, the post hole drill apparatus, the post driver apparatus, and the fence wiring apparatus.

2. The fence installation system of claim 1 further comprising the control apparatus having a control panel, a display screen, a GPS unit, a CPU, and a power management center coupled within a control housing.

3. The fence installation system of claim 2 further comprising the control housing being selectively engageable with the chassis or within a cab of the tractor.

4. The fence installation system of claim 1 further comprising a storage tray coupled to the dispenser inner side above the feeder tray, the storage tray being configured to secure shorter fence posts.

5. The fence installation system of claim 1 further comprising a vacuum apparatus coupled to the trailer apparatus, the vacuum apparatus comprising a vacuum tank coupled to the chassis adjacent the second robotic arm and a suction hose extending from the vacuum tank to the drill head.

6. The fence installation system of claim 5 further comprising the drill head having an outer shroud and a drill motor centrally coupled within the outer shroud, the outer shroud having an exhaust port extending through a shroud top side to receive the suction hose.

7. The fence installation system of claim 6 further comprising the auger bit having a bit shaft and a helical blade, the bit shaft being hollow and having a plurality of suction apertures extending therethrough, the bit shaft being in fluid communication with the suction hose to draw dirt through the suction apertures.

8. The fence installation system of claim 1 further comprising each of the first robotic arm, the second robotic arm, and the third robotic arm having a base pivot, a medial pivot, and a distal pivot.

9. The fence installation system of claim 1 further comprising the fence wiring apparatus having four wire spools.

10. The fence installation system of claim 1 further comprising a tamping head, the tamping head having a crown selectively engageable with the driver head and at least three tamping rods extending from the crown; the driver head being 360° rotatable.

11. The fence installation system of claim 10 further comprising each tamping rod being slidably coupled within a plurality of adjustment slots radially extending through the crown.

12. A fence installation system comprising:

a trailer apparatus comprising a chassis, a plurality of wheels coupled to the chassis, and a hitch coupled to the chassis, the hitch being configured to selectively engage a tractor;

a post dispenser apparatus coupled to the trailer apparatus, the post dispenser apparatus comprising:

a dispenser body coupled to the chassis, the dispenser body defining a post storage cavity configured to secure a plurality of fence posts and having an open dispenser top side extending through to the post storage cavity;

a feeder tray coupled to the dispenser body, the feeder tray extending from a dispenser inner side adjacent a dispenser bottom side, a feed aperture extending through the dispenser inner side to the post storage cavity; and a storage tray coupled to the dispenser inner side above the feeder tray, the storage tray being configured to secure shorter fence posts;

a post holder apparatus coupled to the trailer apparatus, the post holder apparatus comprising:

a first robotic arm coupled to the chassis; and a claw coupled to the first robotic arm, the claw being configured to secure the fence posts;

a post hole drill apparatus coupled to the trailer apparatus, the post hole drill apparatus comprising:

a second robotic arm coupled to the chassis;

a drill head coupled to the second robotic arm, the drill head having an outer shroud and a drill motor centrally coupled within the outer shroud, the outer shroud having an exhaust port extending through a shroud top side; and an auger bit coupled to the drill head, the auger bit having a bit shaft and a helical blade, the bit shaft being hollow and having a plurality of suction apertures extending therethrough;

a vacuum apparatus coupled to the trailer apparatus, the vacuum apparatus comprising:

a vacuum tank coupled to the chassis adjacent the second robotic arm; and a suction hose extending from the vacuum tank to the exhaust port of the outer shroud of the drill head, the bit shaft being in fluid communication with the suction hose to draw dirt through the suction apertures;

a post driver apparatus coupled to the trailer apparatus, the post driver apparatus comprising:

a third robotic arm coupled to the chassis, each of the first robotic arm, the second robotic arm, and the third robotic arm having a base pivot, a medial pivot, and a distal pivot;

a driver head coupled to the third robotic arm, the driver head having a hydraulic piston configured to drive the fence post into the ground, the driver head being 360° rotatable; and a tamping head, the tamping head having a crown selectively engageable with the driver head and at least three tamping rods extending from the crown, each tamping rod being slidably coupled within a plurality of adjustment slots radially extending through the crown;

a fence wiring apparatus coupled to the trailer apparatus, the fence wiring apparatus comprising:

a spool axle coupled to the chassis; and a plurality of wire spools coupled to the spool axle; and a control apparatus, the control apparatus being in operational communication with each of the post holder apparatus, the post hole drill apparatus, the post driver apparatus, and the fence wiring apparatus, the control apparatus having a control panel, a display screen, a GPS unit, a CPU, and a power management center coupled within a control housing, the control housing being selectively engageable with the chassis or within a cab of the tractor.

13. The fence installation system of claim 12 further comprising a replacement hose being coupled to the vacuum tank and extending to the driver head to replace dirt and debris from the vacuum tank into the hole dug by the post hole drill apparatus.

* * * * *